US005167104A

United States Patent [19]

Alvarado

[11] Patent Number: 5,167,104

[45] Date of Patent: Dec. 1, 1992

[54] WEEP HOLE COVER

[76] Inventor: Ciro Alvarado, 5301 Lanis Dr., Dickinson, Tex. 77539

[21] Appl. No.: 726,957

[22] Filed: Jul. 8, 1991

[51] Int. Cl.[5] ..... E04D 1/30

[52] U.S. Cl. ..... 52/302; 454/276; 52/553

[58] Field of Search ..... 52/302, 303, 553; 454/271, 276, 354, 366, 339, 359, 367, 368, 353, 275

[56] References Cited

U.S. PATENT DOCUMENTS

| | | | |
|---|---|---|---|
| 905,157 | 12/1908 | Doyle | 454/339 |
| 2,530,919 | 11/1950 | Taylor | 52/553 |
| 2,551,223 | 5/1951 | Schneider | 454/366 |
| 4,325,291 | 3/1982 | Paynton et al. | 454/14 |
| 5,046,408 | 9/1991 | Eugenio | 454/359 |

*Primary Examiner*—James L. Ridgill, Jr.
*Attorney, Agent, or Firm*—Richard C. Litman

[57] ABSTRACT

A weep hole cover for covering existing weep holes in masonry walls in a manner to permit moisture drainage from and ventilation of the existing weep holes while preventing entry of insects into said weep holes. The weep hole cover includes a top planar sheet sloping downwardly and outwardly from the masonry wall at an acute angle approximating 10 degrees, sidewalls integral with said top planar sheet, each sidewall ending in an outwardly extending flange engageable with the masonry wall, and a bottom planar sheet integral with the top planar sheet and the side walls and having an edge engageable with the masonry wall. The bottom planar sheet has a plurality of pin holes enabling drainage and ventilation while preventing insect entry. The weep hole cover is sealably attached to the masonry wall by silicone adhesive around the perimeter thereof. The cover may be formed of aluminum siding material, or alternatively of molded plastic such as polyethylene, and may be colored to match adjacent portions of the masonry wall.

19 Claims, 1 Drawing Sheet

WEEP HOLE COVER

BACKGROUND OF THE INVENTION

1. Field of the Invention

This invention relates generally to a weep hole cover which fits over a weep hole in a brick wall so as to prevent the intrusion of insects while simultaneously allowing vapor and moisture to pass through the weep hole openings.

In a house of masonry construction it is conventional to provide a series of weep holes in the mortar joints near ground level for ventilation. Ordinarily the weep holes are provided between bricks by omitting all or a portion of the mortar seal between two bricks. The absence of weep holes can cause water to accumulate in the interior wall construction with substantial damage resulting to the dwelling, particularly in humid or damp areas of the country.

Because of the proximity of the weep holes to ground level, the holes are a point of entrance for various types of insects. Accordingly, it is desirable to provide a means to prevent entry of insects while allowing vapor and moisture to pass.

2. Description of the Related Prior Art

Weep hole arrangements designed to prevent entrance of insects are known in the prior art. U.S. Pat. No. 2,905,072, issued Sep. 22, 1959, to Anthony C. Oswald discloses a plate having the appearance of clapboard siding, formed with a trough at the bottom thereof having ventilating holes in the base, the trough carrying bronze or copper screening. The plate is inserted beneath a clapboard along the top of the plate while the trough bears against an adjacent lower clapboard, the ventilating holes allowing ventilation while the screening prevents entrance of insects.

U.S. Pat. No. 3,429,084, issued Feb. 25, 2969, to Ben Brewer, discloses an insect-proof weep hole comprising a relatively fine mesh screen unit installed into the weep hole, and an ant trap chamber which is installed adjacent one end of the inner duct of the weep hole. The weep hole has a generally z-shaped configuration when viewed from the side.

U.S. Pat. No. 4,102,093, issued Jul. 25, 1978 to William F. Harris, discloses an insect control system for buildings of masonry construction comprising a fine mesh aluminum screen, and an inserter mechanism for forcing the screen into a weep hole.

U.S. Pat. No. 4,282,691, issued Aug. 11, 1981 to David G. Risdon, discloses a weep hole device comprising a tube having a water inlet and outlet. The tube passes through the weep hole, the tube comprising an elongated durable porous wick material which extends outwardly from the water inlet to absorb moisture. The outlet end has a screen cap to prevent pests from entering.

SUMMARY AND OBJECTS OF THE INVENTION

In the above identified patents, the representative weep holes either require modification prior to construction as in the patents to Oswald, Brewer, and Risdon, or forcible insertion of a screen into the weep hole subsequent to construction, as in Harris. None of the known prior art discloses a weep hole cover which may be easily mounted over a weep hole without modification of the weep hole after a brick wall has been constructed.

It is an object of this invention to provide a weep hole cover which avoids the defects of prior art weep hole arrangements.

More specifically, it is an object of this invention to provide a weep hole cover which is easily attachable to a brick wall for allowing moisture drainage and ventilation while prohibiting entrance of insects.

It is a further object of this invention to provide an inexpensive one-piece weep hole cover formed of metal or plastic material which may be attached to bricks with a silicone adhesive.

The foregoing and other objects are achieved by forming a weep hole cover from a thin sheet of aluminum siding material. The top sheet portion of the cover is flush fitting on a brick wall and gradually slopes down and out at about a 10 degree angle, for a length of approximately 3¾ inches along the brick wall. At its bottom edge, a sheet portion extends in to perpendicularly engage the brick wall, a distance of approximately ¾ inch. The bottom sheet portion is provided with tiny pin holes allowing for moisture drainage and ventilation. The top sheet portion is approximately 1¼ inches wide. Integral with the edge of the triangular sides adjacent the wall and extending from the top to the bottom are two side flanges each approximately ¼ inch wide. The top edge of the top cover, the two side flanges, and the edge of the bottom sheet portion adjacent to the wall are attached to the brick wall by a silicone adhesive, thereby effecively sealing out insects from entrance to the weep hole between the cover and the wall.

It is contemplated that the manufactured product would be polyethylene molded in various brick colors and sizes. The disclosed weep hole cover may be attached to the house wall at any time subsequent to the completion of the construction of the wall.

Other objects, features and advantages of this invention will become apparent from the following detailed description and the appended claims, reference being had to the accompanying drawing forming a part of the specification, wherein like reference numerals designate corresponding parts of the several views.

DETAILED DESCRIPTION OF THE PREFERRED EMBODIMENT

Before explaining in detail the present invention, it is to be understood that the invention is not limited in its application to the details of construction and arrangement of parts illustrated in the accompanying drawings, since the inveniton is capable of other embodiments and of being practiced or carried out in various ways. Also it is to be understood that the phraseology and terminology employed herein is for the purpose of description and not limitation.

Figure 2:
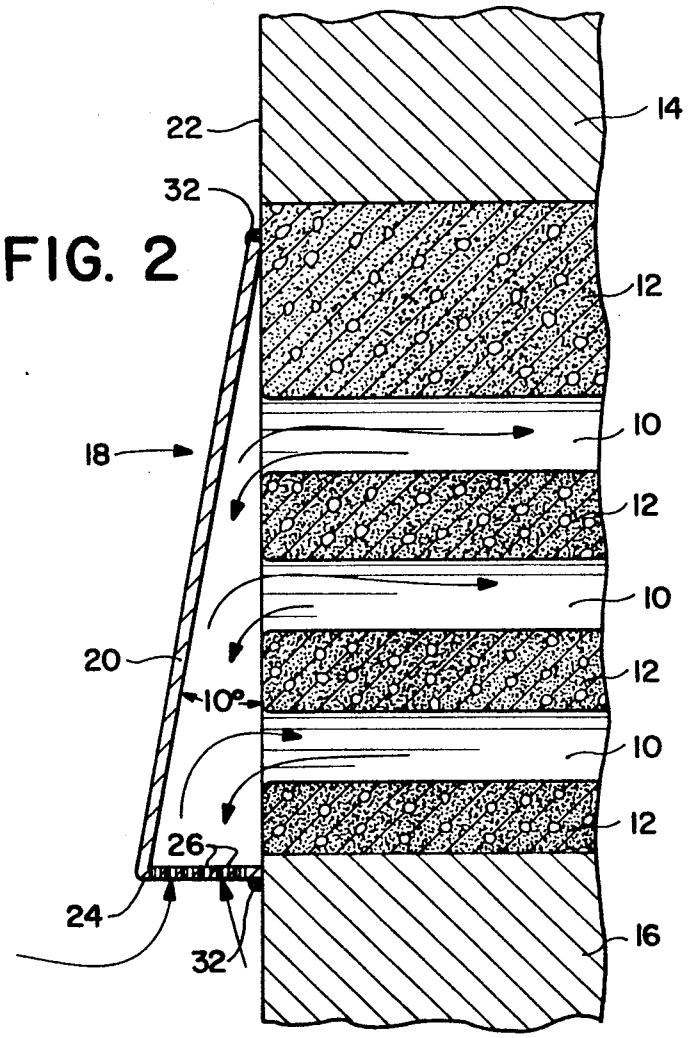
FIG. 2 is a cross-sectional view taken along line 2—2 of FIG. 1 showing the weep hole cover in relation to weep holes in a brick wall.
Figure 1:
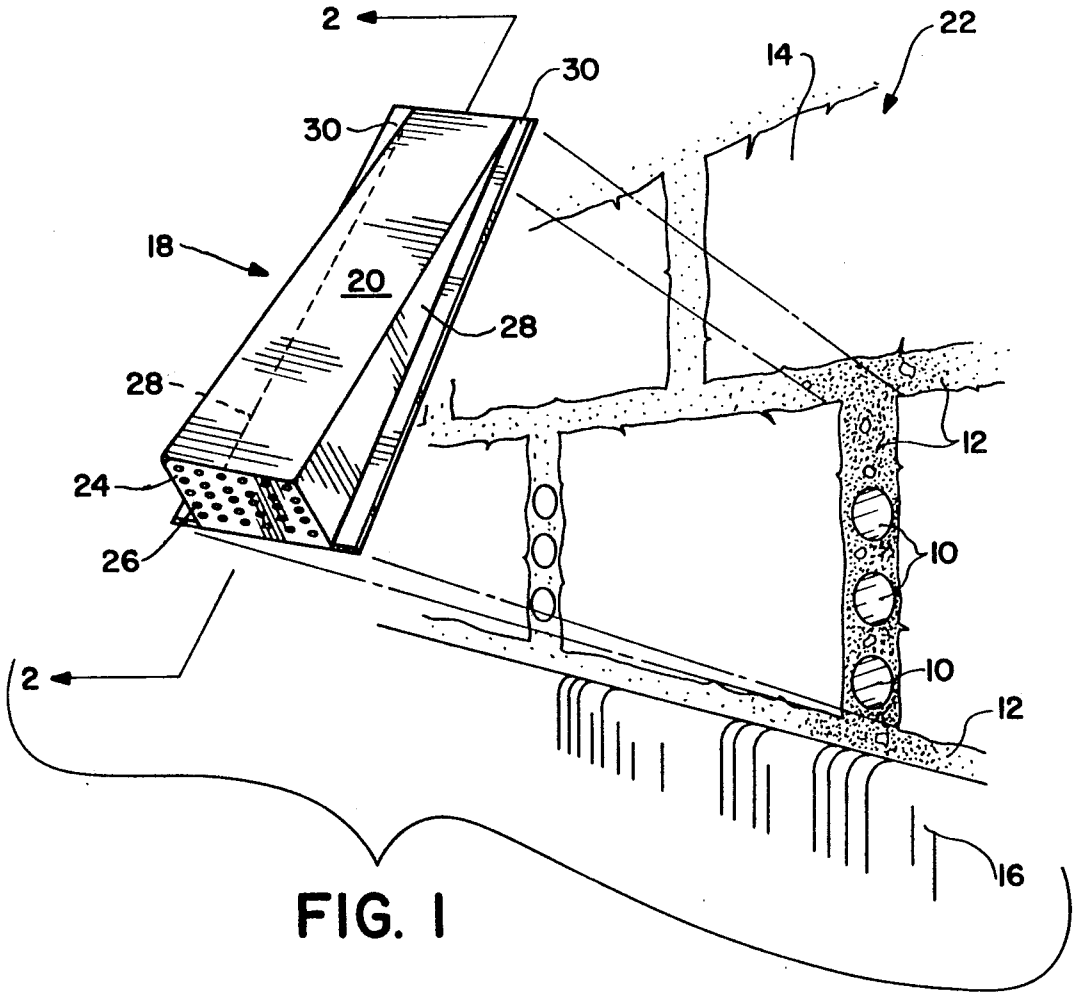
FIG. 1 is an exploded perspective view of the weep hole cover and the corresponding weep holes in the mortar or concrete between bricks in a wall.

In FIGS. 1 and 2, there is shown a series of weep holes 10 which have been provided in the mortar 12 between bricks 14 along the bottom row of bricks above foundation 16. Weep holes 10 are provided to allow for moisture drainage and ventilation for the purpose of keeping the house structure dry, particularly during periods of high humidity. However, the presence of weep holes 10 also provides an easy entrance for a variety of bugs.

Also shown in FIGS. 1 and 2 is a weep hole cover 18 which may be formed from a thin sheet of aluminum siding or molded from plastic such as polyethylene in various brick colors and sizes. Cover 18 includes a top planar sheet 20 flush with wall 22 at the top edge of sheet 20 and sloping down and outwardly at about an angle of 10 degrees. The length of top planar sheet 20 is about 3¾ inches, sufficient to extend beyong the height of a row of bricks 14 and to cover the weep holes 10 contained in the mortar 12 between bricks 14 in said row of bricks. Integral with the bottom edge of said top planar sheet 20 is a bottom planar sheet 24 which extends perpendicularly towards and engages with wall 22. Bottom planar sheet 24 includes a plurality of tiny pin holes 26 which alllow moisture drainage and ventilation while preventing the intrusion of insects.

Integral with top planar sheet 20 and bottom planar sheet 24 are two triangular shaped sidewalls 28 ending in flanges 30 which are parallel to wall 22. The bottom surfaces of flanges 30 together with edge 32 of bottom planar sheet 24 and the top edge 34 of top planar sheet 20 are fastened to wall 22 by a silicone adhesive 32, to thereby seal weep hole cover 18 to wall 22. The bottom planar sheet 24 has a height of ¾ inch. Top planar sheet 20 equals 1¼ inches in width with each flange 30 having a width of ¼ inch.

Weep hole cover 18 may be used with brick walls 22 or with brick veneer siding (not shown) after the walls 22 or siding have been erected and without modification of the walls 22, siding or weep holes 10.

While it will be apparent that the preferred embodiment of the invention herein disclosed is well calculated to fulfill the objects above-stated, it will be appreciated that the invention is susceptible to modification, variation and change without departing from the proper scope or fair meaning of the subjoined claims.

I claim:

1. A weep hole cover for a wall having a plurality of generally horizontally extending and vertically spaced apart weep holes therethrough comprising:

a top planar sheet having a top edge engageable with a wall and sloping downwardly and outwardly at an acute angle with said wall;

a bottom planar sheet integral with a bottom edge of said top planar sheet and extending perpendicular to and engageable with said wall, said bottom planar sheet having a plurality of pin holes therein enabling drainage from and ventilation of said weep holes while preventing entry of insects therethrough;

two triangularly-shaped sidewalls integral with said top planar sheet and bottom planar sheet and extending from each side of said top planar sheet toward side wall and engageable with said wall; and a flange extending outwardly from a wall engaging edge of each sidewall; said weep hole cover being attached to said side wall by adhesive means so as to cover said weep holes whereby moisture may be drained from said weep holes while denying entry of insects into said weep holes.

2. A weep hole cover as in claim 1, formed of a light piece of aluminum siding material.

3. A weep hole cover as in claim 1, formed of molded plastic material.

4. A weep hole cover as in claim 1, wherein said weep holes are provided in mortar between bricks in a lower row of bricks in a brick wall, said weep hole cover being colored to match the color of said mortar and said bricks.

5. A weep hole cover as in claim 1, wherein said weep holes are provided in brick veneer, said weep hole cover being colored to match said brick veneer in the vicinity of said weep holes.

6. A weep hole cover as in claim 1, said acute angle being approximately 10 degrees.

7. A weep hole cover as in claim 1, said adhesive means comprising a silicone adhesive.

8. A weep hole cover as in claim 7, said silicone adhesive forming a continuous seal between said wall and the perimeter of said weep hole cover.

9. A weep hole cover as in claim 8, said cover being formed of a light piece of aluminum siding material.

10. A weep hole cover as in claim 8, said cover being formed of molded plastic material.

11. A weep hole cover as in claim 9, wherein said weep holes are provided in mortar between bricks in a lower row of bricks in a brick wall, said weep hole cover being colored to match the color of said mortar and said bricks.

12. A weep hole cover as in claim 10, wherein said weep holes are provided in mortar between bricks in a lower row of bricks in a brick wall, said weep hole cover being colored to match the color of said mortar and said bricks.

13. A weep hole cover as in claim 8, said weep holes being provided in brick veneer, said weep hole cover being colored to match said brick veneer in the vicinity of said weep holes.

14. A weep hole cover as in claim 3, said weep holes being provided in brick veneer, said weep hole cover being colored to match said brick veneer in the vicinity of said weep holes.

15. A weep hole cover for covering a plurality of weep holes formed in a masonry wall, said cover comprising:

a top planar sheet extending outwardly and downwardly from said masonry wall at an acute angle;

triangularly shaped sidewalls extending from said top planar sheet toward said masonry wall and ending in respective flanges engaging said masonry wall, said sidewalls being integral with said top planar sheet and said respective flanges; and a bottom planar sheet integral with said top planar sheet and said sidewalls, and extending toward said masonry wall to engage said masonry wall, said bottom planar sheet having a plurality of pin holes therein to enable moisture drainage from and ventilation of said weep holes in said masonry wall while preventing entry of insects therethrough;

said weep hole cover being sealably attached to said masonry wall by silicone adhesive continuously applied around the perimeter of said weep hold cover in engagement with said masonry wall.

16. A weep hole cover as in claim 15, said cover being formed of aluminum siding material.

17. A weep hole cover as in claim 15, said cover being formed of molded plastic material.

18. A weep hole cover as in claim 16, said cover being colored to match said masonry wall.

19. A weep hole cover as in claim 17, said cover being colored to match said masonry wall.

* * * * *